US009885367B2

(12) United States Patent
Suzuki et al.

(10) Patent No.: US 9,885,367 B2
(45) Date of Patent: Feb. 6, 2018

(54) CENTRIFUGAL FAN

(71) Applicant: MINEBEA CO., LTD., Kitasaku-Gun, Nagano (JP)

(72) Inventors: Yuzuru Suzuki, Hamamatsu (JP); Seiya Fujimoto, Fukuroi (JP); Takako Otsuka, Fukuroi (JP); Masaki Ogushi, Fukuroi (JP)

(73) Assignee: Minebea Co., Ltd., Nagano (JP)

( * ) Notice: Subject to any disclaimer, the term of this patent is extended or adjusted under 35 U.S.C. 154(b) by 225 days.

(21) Appl. No.: 13/928,809

(22) Filed: Jun. 27, 2013

(65) Prior Publication Data

US 2014/0010682 A1 Jan. 9, 2014

(30) Foreign Application Priority Data

Jul. 5, 2012 (JP) ..... 2012-151750

(51) Int. Cl.
*F04D 29/40* (2006.01)
*F04D 29/66* (2006.01)
(Continued)

(52) U.S. Cl.
CPC ..... *F04D 29/403* (2013.01); *F04D 25/0613* (2013.01); *F04D 25/08* (2013.01);
(Continued)

(58) Field of Classification Search
CPC .. F04D 25/06; F04D 25/0606; F04D 25/0613; F04D 25/08; F04D 29/26;
(Continued)

(56) References Cited

U.S. PATENT DOCUMENTS 5,979,541 A * 11/1999 Saito ..... 165/80.3
8,834,112 B2 * 9/2014 Fukuda ..... F04D 29/162 415/204
(Continued)

FOREIGN PATENT DOCUMENTS

EP 1 479 917 A1 11/2004
JP S54-132007 U 9/1979
(Continued)

OTHER PUBLICATIONS

Japanese Office Action dated Apr. 22, 2014 in the corresponding JP patent application 2012-151750.
(Continued)

*Primary Examiner* — Theodore Stigell
*Assistant Examiner* — Chirag Jariwala
(74) *Attorney, Agent, or Firm* — Carrier Blackman & Associates, P.C.; Joseph P. Carrier; Jeffrey T. Gedeon

(57) ABSTRACT

A centrifugal fan includes an impeller and a motor which rotates the impeller. The impeller includes an upper shroud, a lower shroud, and blades arranged therebetween. A rotor of the motor is attached to an attachment part of the lower shroud. In a section passing a rotary shaft of the impeller, the rotor and the attachment part are provided at a more outer side than a circle having a center on a line passing an upper end portion of an inlet opening at an inner side and parallel to the rotary shaft of the impeller, having a radius of 80% of a distance from the upper end portion of the inlet opening to a surface of the lower shroud below the upper end portion, and being tangent to the surface of the lower shroud or passing an end edge portion of the lower shroud.

6 Claims, 16 Drawing Sheets

(51) Int. Cl.

| | |
|---|---|
| ***F04D 25/08*** | (2006.01) |
| ***F04D 29/42*** | (2006.01) |
| ***F04D 25/06*** | (2006.01) |
| ***F04D 29/059*** | (2006.01) |
| ***F04D 29/28*** | (2006.01) |

(52) U.S. Cl.
CPC ..... *F04D 29/059* (2013.01); *F04D 29/281* (2013.01); *F04D 29/4226* (2013.01); *F04D 29/666* (2013.01)

(58) Field of Classification Search
CPC ..... F04D 29/28; F04D 29/281; F04D 29/40; F04D 29/403; F04D 29/282; F04D 29/42; F04D 29/2216; F04D 29/4206; F04D 29/4226; F04D 29/661; F04D 29/663; F04D 29/666; F04D 1/00; F04D 17/08; F04D 17/16; F04D 17/165; F04D 13/0673
USPC ..... 417/352–354, 423.1, 423.14
See application file for complete search history.

(56) References Cited

U.S. PATENT DOCUMENTS

| | | | | |
|---|---|---|---|---|
| 9,039,362 | B2 * | 5/2015 | Fukuda | F04D 25/0613 415/206 |
| 2002/0150478 | A1 | 10/2002 | Aoki | |
| 2005/0058543 | A1 | 3/2005 | Takeshita et al. | |
| 2005/0140233 | A1 * | 6/2005 | Kojima et al. | 310/156.37 |
| 2006/0289229 | A1 * | 12/2006 | Yamaguchi | 181/290 |
| 2010/0232967 | A1 * | 9/2010 | Oguma et al. | F04D 29/441 416/182 |
| 2011/0038743 | A1 * | 2/2011 | Yen et al. | 417/410.1 |
| 2012/0045323 | A1 * | 2/2012 | Kagawa et al. | 415/206 |
| 2012/0134795 | A1 | 5/2012 | Fukuda et al. | |
| 2012/0156025 | A1 * | 6/2012 | Fukuda | F04D 29/162 415/206 |
| 2012/0219437 | A1 * | 8/2012 | Nakamura | A47L 5/22 417/423.1 |
| 2012/0269617 | A1 * | 10/2012 | Horng | F04D 17/16 415/122.1 |

FOREIGN PATENT DOCUMENTS

| | | | |
|---|---|---|---|
| JP | S56-088995 | A | 7/1981 |
| JP | 63-289295 | A | 11/1988 |
| JP | H03253244 | A | 11/1991 |
| JP | 08-312586 | A | 11/1996 |
| JP | H10-234168 | A | 9/1998 |
| JP | 11-148493 | A | 6/1999 |
| JP | 2002-370517 | A | 12/2002 |
| JP | 2003-328994 | A | 11/2003 |
| JP | 2003-348795 | A | 12/2003 |
| JP | 2004-343876 | A | 12/2004 |
| JP | 2004-346840 | A | 12/2004 |
| JP | 2005-090346 | A | 4/2005 |
| JP | 2007-023877 | A | 2/2007 |
| JP | 2007158933 | A | 6/2007 |
| JP | 2010-090835 | A | 4/2010 |
| JP | 2011-174386 | A | 9/2011 |
| JP | 2012-112336 | A | 6/2012 |

OTHER PUBLICATIONS

Office Action dated Jul. 29, 2015 in the corresponding Japanese Patent Application No. 2014-127043.
Office Action dated Jan. 31, 2017 in the corresponding, divisional, Japanese patent application 2016-051449.

* cited by examiner

FIG.17 RELATED-ART

RELATED-ART

CENTRIFUGAL FAN

BACKGROUND OF THE INVENTION

1. Field of the Invention

The present invention relates to a centrifugal fan, and more particularly, to a centrifugal fan capable of reducing noise caused due to air blowing.

2. Description of the Related Art

FIG. 17 is a perspective view showing an example of a related-art centrifugal fan. FIG. 18 is a side sectional view showing the example of the related-art centrifugal fan.

As shown in FIGS. 17 and 18, a centrifugal fan 801 includes a casing 810 having an inlet opening 813 (833) and outlet openings 819, and an impeller 830 accommodated in the casing 810. The impeller 830 includes a plurality of blades 851 around a rotary shaft of a motor 860. The centrifugal fan 801 introduces air taken from the inlet opening 813 (833), from a center of the impeller 830 towards between the blades 851 and discharges the air in a radially outward direction of the impeller 830 with a hydrodynamic force generated by a centrifugal action resulting from rotation of the impeller 830. The air which is discharged outwards from an outer periphery of the impeller 830 is then discharged through the outlet openings 819 of the casing 810. Each blade 851 has a vertical end edge portion at a side of the inlet openings 813.

As shown in FIG. 18, the centrifugal fan 801 is thin. The centrifugal fan 801 includes the motor 860 for rotating the impeller 830 at a substantially center part of the casing 810. The motor 860 is an outer rotor brushless motor having a rotor yoke 863 attached to the impeller 830.

The centrifugal fan 801 is widely used for an electrical household appliance, an OA equipment, cooling, ventilation and air conditioning of an industrial equipment, a vehicular blower and the like. The blowing performance and noise of the centrifugal fan 801 are highly influenced by a blade shape of the impeller 830 and a shape of the casing 810 (a structure of the centrifugal fan 801).

In order to reduce the noise and to improve the blowing performance, the shape of the impeller and the structure of the casing have been optimized, and a variety of suggestions have been made.

For example, a centrifugal fan has been suggested which optimizes a blade shape to thereby reduce the noise (for example, refer to JP-A-S63-289295).

In this thin-type centrifugal fan 801, however, the noise is apt to occur. That is, there is a limitation on the thinning of the motor 860 for rotating the impeller 830. Therefore, when the centrifugal fan 801 is made to be thin, a height of the motor 860 becomes relatively larger than that of the centrifugal fan 801. Thus, as shown in FIG. 18, the rotor yoke 863 of the motor 860 protrudes to the center part of the inlet opening 813 (833) of the centrifugal fan 801. The rotor yoke 863 protruding to the inlet opening 813 (833) disturbs flowing of the air from the inlet opening 813 (833) towards the outlet openings 819, so that the noise is generated.

SUMMARY OF THE INVENTION

The present invention has been made in view of the above circumstances, and an object of the present invention is to provide a thin centrifugal fan capable of reducing noise.

According to an illustrative embodiment of the present invention, there is provided a centrifugal fan comprising: an impeller; a lower casing which is provided below the impeller; and a motor which is mounted to the lower casing and configured to rotate the impeller. The impeller includes an upper shroud, a lower shroud, and a plurality of blades arranged in a circumference direction between the upper shroud and the lower shroud. The centrifugal fan is configured to discharge a fluid taken from an inlet opening formed at an upper part of the upper shroud to a lateral side of the impeller as the impeller is rotated. A rotor of the motor is attached to an attachment part of the lower shroud. In a section passing a rotary shaft of the impeller, both the rotor and the attachment part are provided at a more outer side than a circle, the circle having a center on a line passing an upper end portion of the inlet opening at an inner side and parallel to the rotary shaft of the impeller, and having a radius of 80% of a distance from the upper end portion of the inlet opening at the inner side to a surface of the lower shroud below the upper end portion, and the circle being tangent to the surface of the lower shroud or passing an end edge portion of the lower shroud.

In the above centrifugal fan, the motor may be an outer rotor motor, the rotor may be provided in the inlet opening of the impeller to protrude upwards toward an outside of the inlet opening, and a height of the rotor in an upper-lower direction may be a half or smaller of a height of the centrifugal fan in the upper-lower direction.

In the above centrifugal fan, the lower casing may be made using a metal plate.

In the above centrifugal fan, waffle flattening processing may be performed on at least a part of the lower casing.

In the centrifugal fan, a center part of the lower casing may be formed with a recess part which is recessed downwards, and at least a driving circuit of the motor may be provided in the recess part.

In the above centrifugal fan, a surface of the lower casing, which faces the impeller, may become a part of a wall surface which is configured to guide the fluid taken from the inlet opening.

In the above centrifugal fan, the lower shroud may be provided to only a rotary shaft side of the impeller such that at least an outer periphery part of each blade faces an upper surface of the lower casing.

The above centrifugal fan may further comprise an upper casing which is provided above the impeller, the upper casing may be formed with a circular opening when seen from a plan view such that the fluid is taken into the inlet opening, and a ratio of a height from a lower end of each blade to the inlet opening in an upper-lower direction with respect to an inner diameter of the circular opening may be within a range of 15% or larger and 25% or smaller.

In the above centrifugal fan, a position of the upper end portion of the inlet opening in the upper-lower direction may be same as or higher than an upper end portion of the circular opening.

The above centrifugal fan may further comprise an upper casing which is provided above the impeller, the upper casing may be formed with an opening such that the fluid is taken into the inlet opening, and a position of the upper end portion of the inlet opening in the upper-lower direction may be same as or higher than an upper end portion of the opening of the upper casing.

In the above centrifugal fan, the lower casing may be formed with an aperture part, to which a connector for feeding power to the motor is fixed.

According to the above configuration, both the rotor and the attachment part are provided at the more outer side than the predetermined-size circle which has the center on the line passing the upper end portion of the inlet opening at the inner side and parallel to the rotary shaft of the impeller, and which is tangent to the surface of the lower shroud or passes the end edge portion of the lower shroud. Therefore, the centrifugal fan capable of reducing the noise can be provided.

DETAILED DESCRIPTION

Hereinafter, illustrative embodiments of the present invention will be described.

Figure 1:
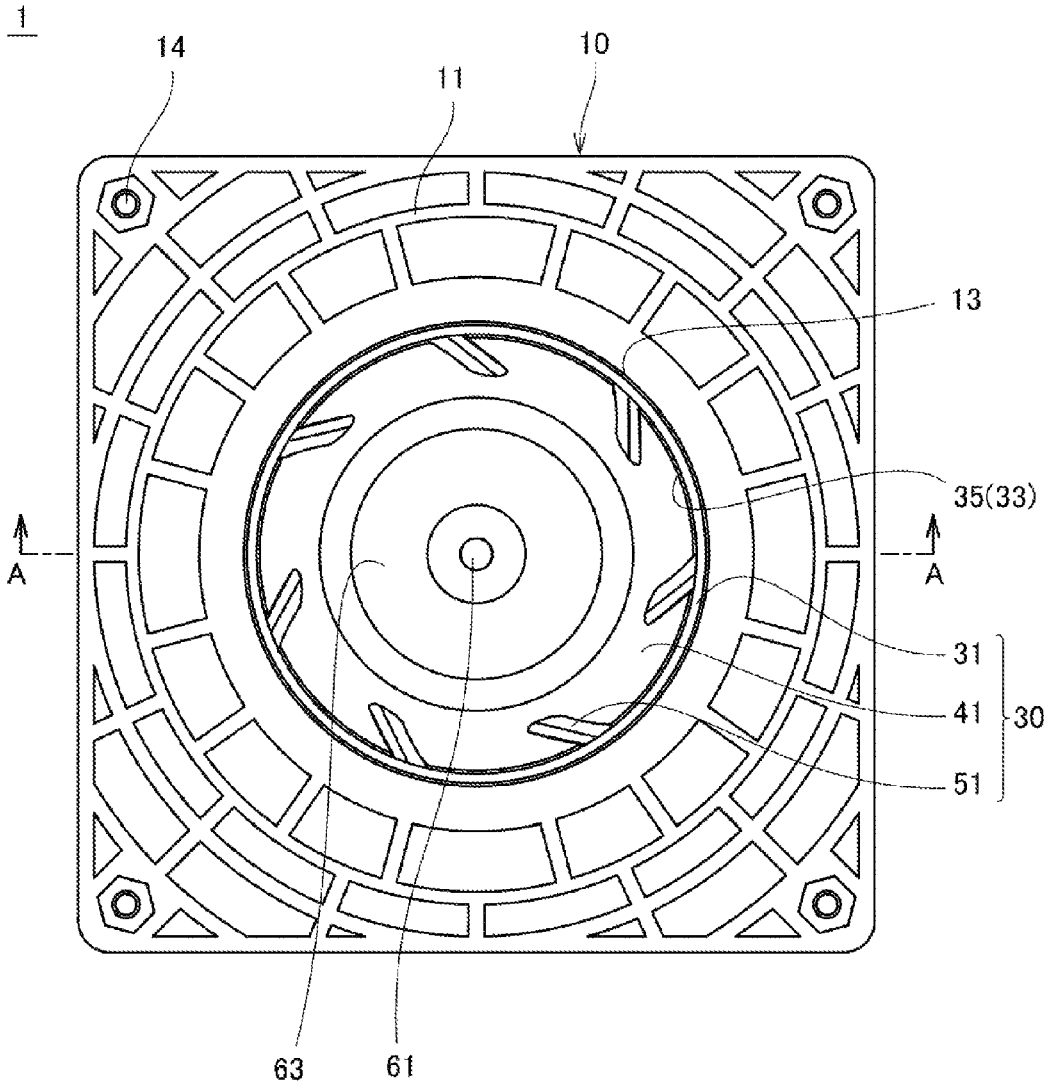
FIG. 1 is a plan view showing a centrifugal fan according to an illustrative embodiment of the present invention.
Figure 2:
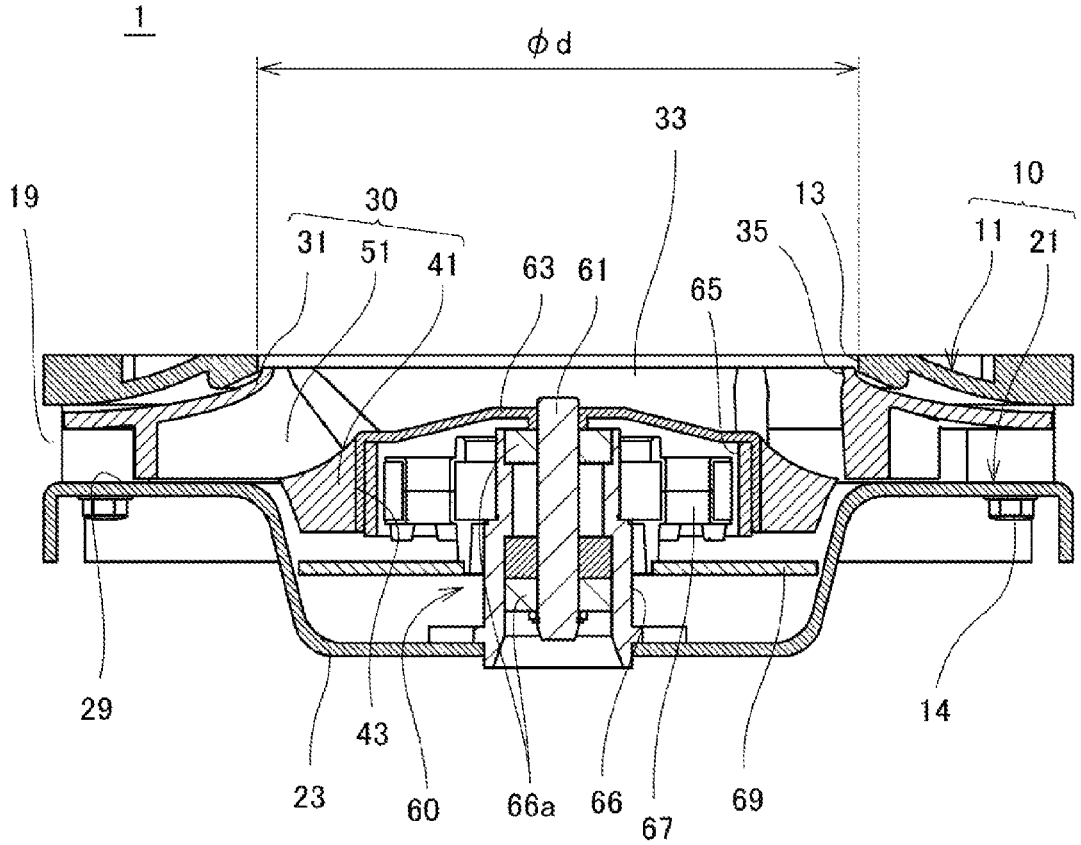
FIG. 2 is a sectional view taken of the centrifugal fan along a line A-A of FIG. 1.
Figure 3:
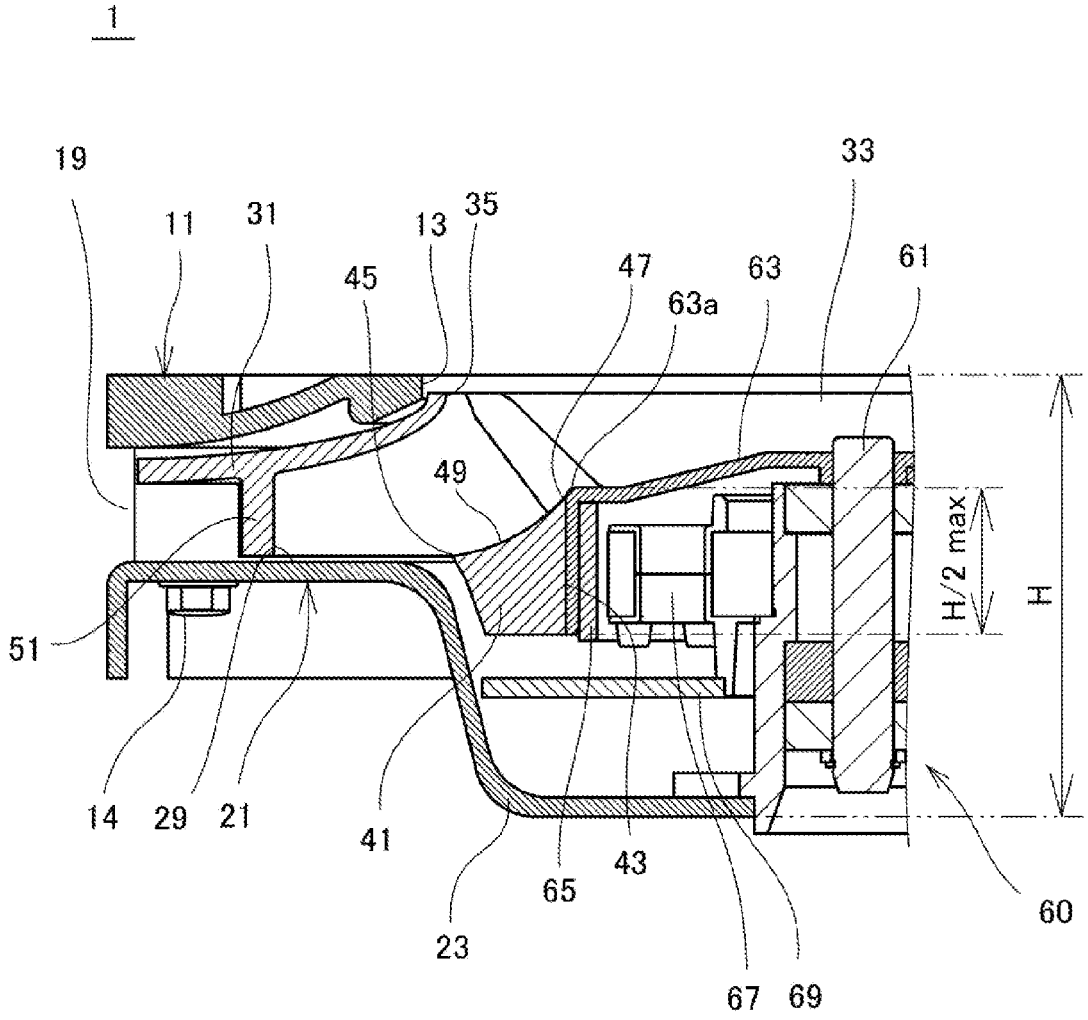
FIG. 3 is a partially enlarged view of FIG. 2.

FIG. 1 is a plan view showing a centrifugal fan according to an illustrative embodiment of the present invention. FIG. 2 is a sectional view of the centrifugal fan taken along a line A-A of FIG. 1. FIG. 3 is a partially enlarged view of FIG. 2.

Referring to FIGS. 1 to 3, a centrifugal fan 1 includes a casing 10, an impeller 30 and a motor 60. The centrifugal fan 1 has a rectangular parallelepiped shape of a substantial square except for a part to which the motor 60 is attached, when seen from the plan view. The centrifugal fan 1 is a thin centrifugal fan having a relatively small size (height) in an upper-lower direction. The impeller 30 is attached to a rotor 63 which rotates together with a shaft 61 of the motor 60. The centrifugal fan 1 rotates the impeller 30 by the motor 60. As the impeller 30 rotates, the centrifugal fan 1 discharges an air (an example of a fluid) taken from an inlet opening 33 thereof to lateral sides of the impeller 30. That is, the air taken from the inlet opening 33 passes between blades 51 of the impeller 30 and is discharged in a radially outward direction of the impeller 30 with a hydrodynamic force generated by a centrifugal action resulting from the rotation of the impeller 30. The air is discharged from outlet openings 19 of the casing 10, which are provided at lateral sides of the impeller 30.

The motor 60 is an outer rotor brushless motor, for example. The motor 60 is mounted to a center part of a lower casing 21 by a fastening member such as screw, bolt and the like. The motor 60 has the rotor 63 which has a shape of a cup, and the rotor 63 opens downwards. An annular magnet 65 is attached on an inner surface of a side periphery of the rotor 63. The shaft 61 is attached to a center part of the rotor 63.

The shaft 61 is rotatably supported by a pair of bearings 66*a* mounted to a bearing holder 66. An outer periphery part of the bearing holder 66 is provided with a stator 67. The stator 67 is configured by a stacked stator core, an insulator mounted to the stator core and having a coil wound thereon or the like. The stator 67 is arranged to face the magnet 65 at a predetermined gap in a radial direction (in a left-right direction in FIG. 2). The stator 67 is connected to a circuit board 69. The circuit board 69 is a printed wiring board, for example. The circuit board 69 is mounted thereon with an electronic component for controlling the motor 60, and the like, and a driving circuit of the motor 60 is mounted thereon.

The casing 10 is configured by an upper casing 11 and a lower casing 21. Specifically, the upper casing 11 and the lower casing 21 are assembled to each other by using screws 14 positioned at four corners, when seen from the plan view, so that the casing 10 is configured. The screw 14 is a bolt which is inserted from the lower casing 21, for example. The upper casing 11 and the lower casing 21 are assembled to each other with pillars being interposed therebetween at parts at which the screws 14 are arranged, for example. Meanwhile, at this time, the pillars may be integrated with any one of the upper casing 11 and the lower casing 21. The outlet openings 19 are provided at lateral sides of the casing 10, except for the fastened parts of the upper casing 11 and the lower casing 21 using the screws 14, and between the upper casing 11 and the lower casing 21.

The impeller 30 is accommodated in the casing 10. The impeller 30 has a disc shape as a whole. The upper casing 11 is provided above the impeller 30, and the lower casing 21 is provided below the impeller 30. That is, the centrifugal fan 1 is configured such that the impeller 30 is sandwiched and held between the upper casing 11 and the lower casing 21.

The impeller 30 includes an upper shroud 31, a lower shroud 41 and a plurality of blades 51 which are arranged between the upper shroud 31 and the lower shroud 41. The impeller 30 is formed at its center part with an inlet opening 33 which opens upwards. The inlet opening 33 is surrounded by an upper end portion 35 of the upper shroud 31 at an inner side. As shown in FIG. 1, the blades 51 are arranged at an appropriate interval in a circumference direction.

The lower shroud 41 in which the rotor 63 is fitted is arranged at the center part of the impeller 30. The lower shroud 41 is provided at its center part with a cylindrical part (an example of an attachment part) 43 formed such that the rotor 63 is provided thereto. The rotor 63 is fitted to the cylindrical part 43, which is provided at the center part of the lower shroud 41, and holds the impeller 30. The rotor 63 is provided in the inlet opening 33 to protrude upwards towards an outside of the inlet opening 33. As shown in FIG. 3, a height of a part of the rotor 63 holding the cylindrical part 43 in an upper-lower direction is set to be a half or smaller of a height H of the centrifugal fan 1 in the upper-lower direction. Thereby, the centrifugal fan 1 can be made relatively thin while the air taken from the inlet opening 33 is not disturbed by the rotor 63.

Each blade 51 has the same curved shape. The blade 51 is a backward inclined blade, which is a so-called turbo type. The shape of the blade 51 is backward inclined as regards the rotating direction thereof. The upper shroud 31, the lower shroud 41 and the blades 51 are integrally molded using a synthetic resin, for example.

The upper casing 11 is formed of a resin such as engineering plastic and the like. The upper casing 11 is formed at its center part with an opening 13. The opening 13 has a circular shape, when seen from the plan view. The opening 13 is formed such that the air is taken into the inlet opening 33 of the impeller 30. The opening 13 has an inner diameter slightly larger than the diameter of the inlet opening 33 which is configured by the upper shroud 31. That is, in this illustrative embodiment, the size of the opening 13 is substantially equivalent to the size of the inlet opening 33.

The lower casing 21 is made of a metal plate such as iron. The lower casing 21 is formed at its center part with a recess part 23 which is recessed downwards. The recess part 23 has a bowl shape. As shown in FIG. 2, in this illustrative embodiment, the motor 60 and a driving circuit of the motor 60 such as the circuit board 69 and the like are housed in the recess part 23. The motor 60 is mounted to the lower casing 21 by a fastening member such as screw, bolt and the like. However, the motor 60 may be mounted to the lower casing 21 by crimping a lower part of the bearing holder 66 to the recess part 23, instead of the fastening member.

An outer periphery part of the lower casing 21 forms a side plate which is bent in an axial direction (upper-lower direction in FIG. 2). The rigidity of the lower casing 21 is increased by providing the side plate.

A part of an upper surface of the lower casing 21, which is around the recess part 23, forms a partition wall part 29 which faces a lower surface of the impeller 30. The partition wall part 29 is formed into a plane shape to be close to the lower surface of the impeller 30.

As shown in FIG. 2, the lower shroud 41 of the impeller 30 is provided to only a side of the shaft (the rotary shaft of the impeller 30) 61 such that at least an outer periphery part of each blade 51 faces the partition wall part 29. That is, the respective blades 51 are exposed at the parts of the impeller 30 facing the partition wall part 29. The surface of the lower casing 21 facing the impeller 30 becomes a part of a wall surface which laterally guides the air, which is taken from the inlet opening 33. The blades 51 are arranged to face the partition wall part 29 at a predetermined gap in the axial direction. In the meantime, at least a portion of the lower part of each blade 51 may be exposed to the partition wall part 29 or the entire thereof may be exposed to the partition wall part 29.

In the meantime, an outer diameter size of the impeller 30 which is accommodated in the casing 10 is set to be smaller than a size of one lateral side of the casing 10. Thereby, the impeller 30 which is rotating does not protrude beyond an outer edge of the casing 10, so that contact of the impeller 30 with the other member and damage resulting from the contact can be prevented.

The lower casing 21 has functions as a main plate which guides the air in the impeller 30 and as a base plate of the casing 10. Thus, a setting of the gap between the impeller 30 and the partition wall part 29 may be important. When the gap is too large, the air taken from the inlet opening 33 passes between the blades 51 and also flows into the gap. As a result, a pressure of the air discharged from the impeller 30 is reduced, so that a blowing characteristic is deteriorated. On the other hand, when the gap is too small, a following problem occurs. That is, when there occurs non-uniformity as regards size precision of each component, the blades 51 may contact the partition wall part 29. In order to prevent the contact, it is necessary to manage the size of each component in high precision, so that the cost of the centrifugal fan 1 is increased. Thus, the gap is appropriately set, taking into consideration the above aspects.

A ratio of a height h from a lower end of each blade 51 to an upper end portion of the inlet opening 33 in the upper-lower direction with respect to an inner diameter (which is denoted with φd in FIG. 2) of the opening 13 is within a range of 15% or larger and 25% or smaller. That is, a relation between the height h and the inner diameter φd of the opening 13 is expressed as follows.

$$0.15 \leq h/\varphi d \leq 0.25$$

In this illustrative embodiment, as shown in FIG. 3, an upper surface of the lower shroud 41 is a curved surface 49 which is a downward convex arc-shaped curve, in a side section. An outer periphery end portion 45 of the lower shroud 41 is positioned in the vicinity of a part vertically below the upper end portion 35 of the upper shroud 31. Also, an inner periphery end portion 47 of the lower shroud 41, which is an upper end portion of the cylindrical part 43, is an upper end portion of the lower shroud 41. The inner periphery end portion 47 is positioned in the vicinity of an outer periphery upper end portion 63*a* of the rotor 63. The curved surface 49 is formed between the outer periphery end portion 45 and the inner periphery end portion 47. The lowest part of the curved surface 49 is the outer periphery end portion 45 and the highest part thereof is the inner periphery end portion 47.

Figure 4:
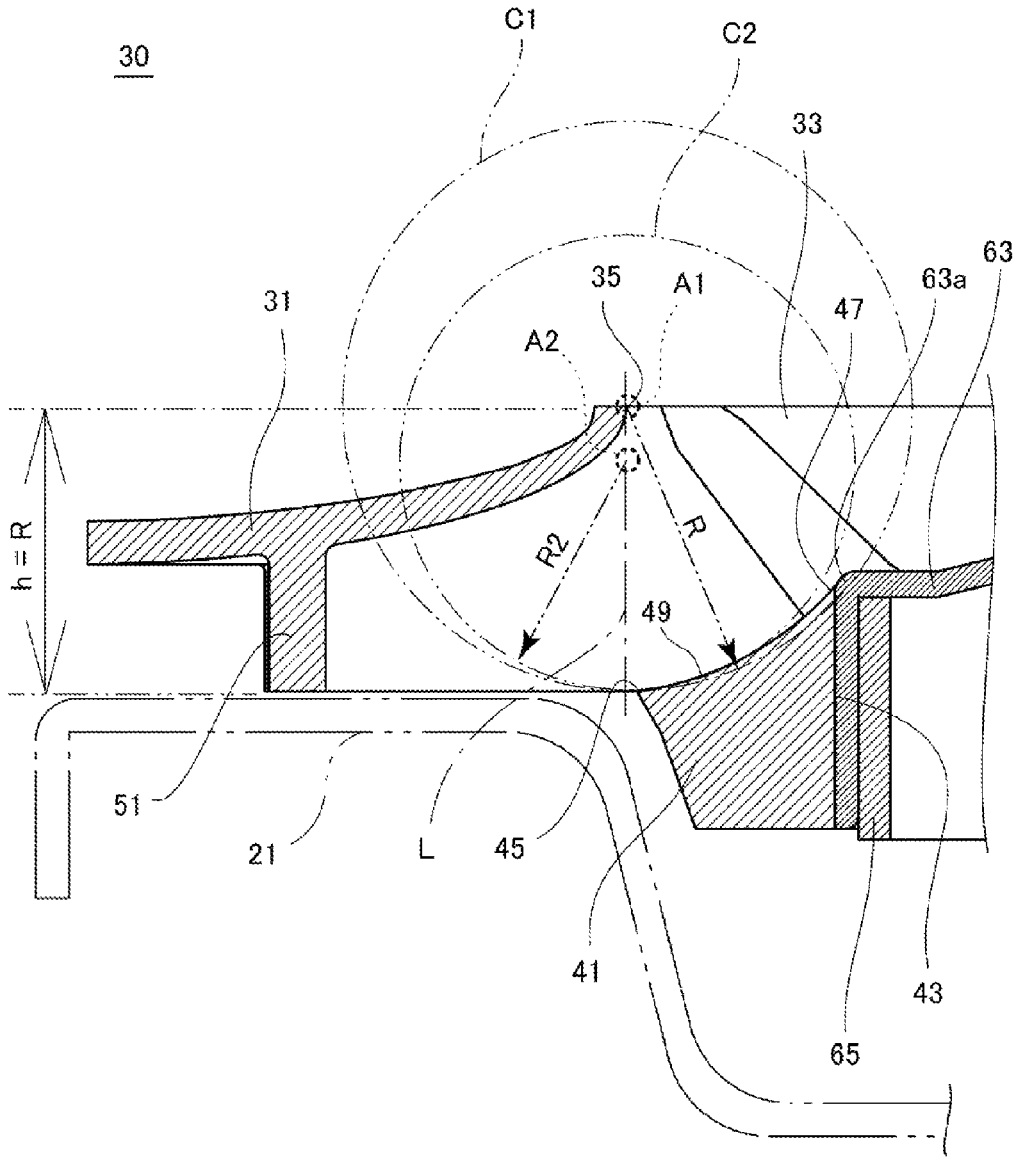
FIG. 4 is an explanatory view of a shape of an impeller.

FIG. 4 is an explanatory view of the shape of the impeller 30.

FIG. 4 is a sectional view in the same section as that shown in FIG. 2. The shape of the lower shroud 41 is further described with reference to FIG. 4. That is, in this illustrative embodiment, the curved surface 49 is formed into an arc shape which has a center on a line L passing the upper end portion 35 of the inner side of the inlet opening 33 and parallel to the rotary shaft of the impeller 30, in a section passing the rotary shaft of the impeller 30 (hereinafter, simply referred to as the section). In the section, the curved surface 49 is formed to be provided at a more outer side than a circle C2 shown in FIG. 4. In other words, the rotor 63 and the lower shroud 41 including the cylindrical part 43 are provided at the more outer side than the circle C2 (not overlap the circle C2) in the section. Thereby, the air flow path from the inlet opening 33 to the outlet opening 19 between the upper shroud 31 and the lower shroud 41 is configured such that the air easily flows.

The circle C2 is a circle which has a center A2 positioned on the line L and passes the outer periphery end portion 45, which is the end edge of the lower shroud 41. A radius R2 of the circle C2 is 80% of a radius R of the circle C1. The circle C1 is a circle having the upper end portion 35 as a center A1 thereof. The radius R of the circle C1 is a distance from the upper end portion 35 to the outer periphery end portion 45 which is positioned in the vicinity of a part of the surface of the lower shroud 41 vertically below the upper end portion 35. That is, in this illustrative embodiment, the radius R of the circle C1 is substantially the same as the height h of the flow path of the air taken from the inlet opening 33 in the upper-lower direction.

In the meantime, the curved surface 49 may be an arc shape having a center which is not positioned on the line L in the section. Also, the curved surface 49 may be non-circular in the section. The curved surface may be elliptical or other curved shape. In any case, the lower shroud 41 including the curved surface 49 is provided at the more outer side than the circle C2 which has a radius of 80% of the distance from the upper end portion 35 to the surface of the curved surface 49 and the center positioned on the line L, and which is tangent to the curved surface 49 in the section. The rotor 63 is also provided at the more outer side than the circle C2. Meanwhile, in this case, the circle C2 may be a circle which has the center A2 positioned on the line L and the radius R2 of 80% of the radius R of the circle C1, and which is tangent to the surface of the lower shroud 41.

In this illustrative embodiment, the lower shroud 41 has the above-described shape, so that following effects can be obtained. That is, in the centrifugal fan 1, it is difficult to make the motor 60 thin, which rotates the impeller 30. Thus, in the related-art technique, the rotor part of the motor is made to protrude the center part of the inlet opening, which disturbs the air flow and causes the noise. However, according to the configuration of this illustrative embodiment, while the centrifugal fan 1 is made to be thin, the air flow path is configured such that the air can smoothly flow. Therefore, the generation of the noise can be suppressed.

Figure 5:
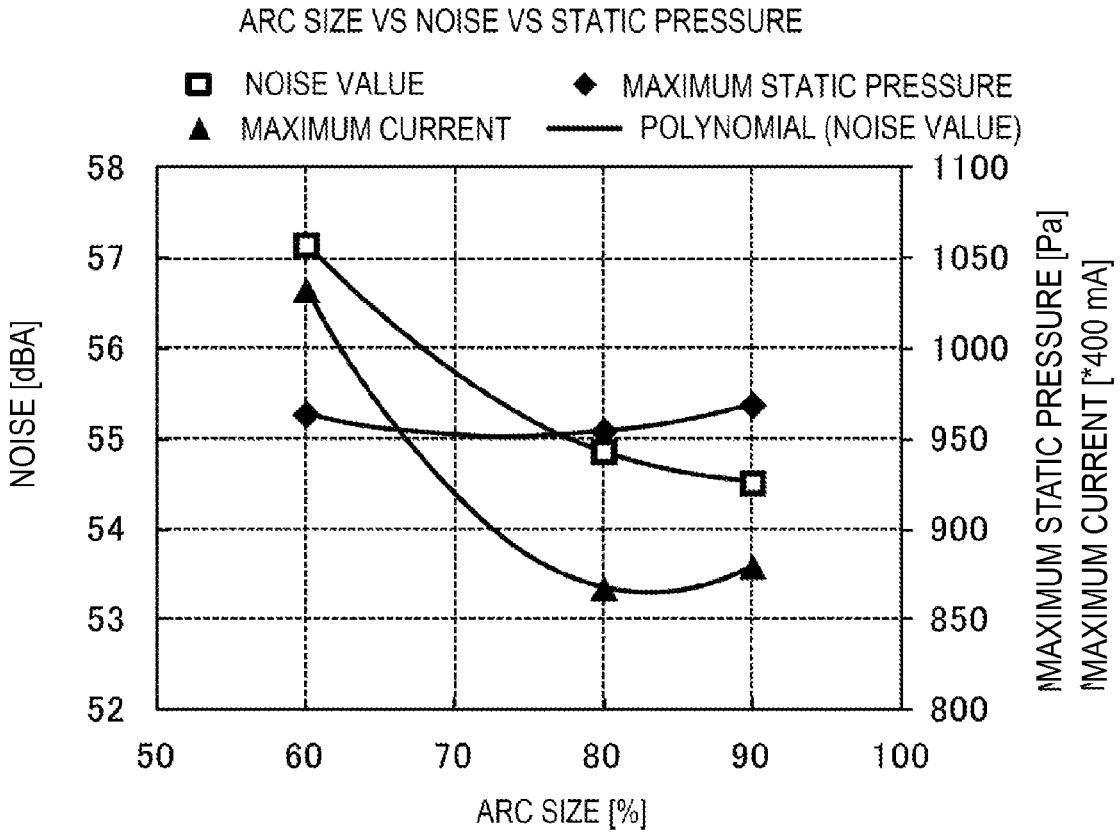
FIG. 5 is a graph showing a relation between a shape of a lower shroud and performance of the centrifugal fan.

FIG. 5 is a graph showing a relation between the shape of the lower shroud 41 and performance of the centrifugal fan 1.

In FIG. 5, an arc size in a horizontal axis indicates a radius of the arc of the curved surface 49, which has a center on a vertical line passing the upper end portion 35 (upper shroud inner periphery part) and which passes the outer periphery end portion of the lower shroud 41 in the section, as a ratio of the radius to the height h of the air flow path where when the radius is the same as the height, the ratio is 100%.

As shown in FIG. 5, the larger the arc size is, a noise value is monotonically decreased. Compared to cases where the arc size is 60% and 70%, when the arc size is 80%, the noise value is remarkably reduced. Compared to the case where the arc size is 80%, when the arc size is 90%, the noise value is reduced but an amount of the reduction is relatively small.

The maximum static pressure is little changed, irrespective of the arc sizes. The maximum current, which flows through the motor 60 when the centrifugal fan 1 operates, is smallest when the arc size is about 80%, is increased a little when the arc size is 90% and is considerably increased when the arc size becomes 70% or 60%.

From the shown relation between the lower shroud 41 and the performance of the centrifugal fan 1, it can be said that when the arc size is larger than 80%, the noise value can be considerably reduced while making the current flowing through the motor 60 small. That is, in this illustrative embodiment, the curved surface 49 of the lower shroud 41 has the shape as described above, so that the noise value of the centrifugal fan 1 can be made relatively small.

Figure 6:
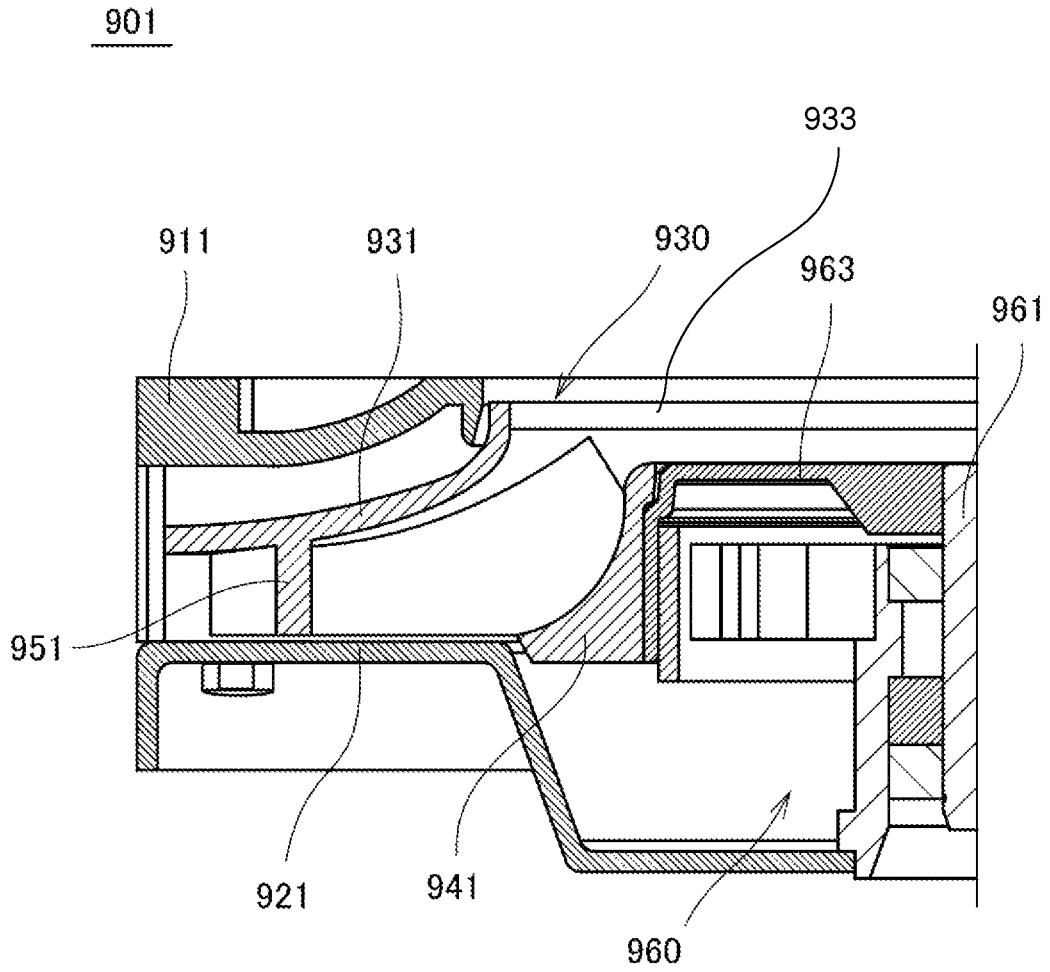
FIG. 6 shows an exemplary configuration of a centrifugal fan according to a comparative example.

FIG. 6 shows an exemplary configuration of a centrifugal fan according to a comparative example.

A centrifugal fan 901 shown in FIG. 6 is a comparative object of the centrifugal fan 1 of this illustrative embodiment. Similarly to the centrifugal fan 1, the centrifugal fan 901 includes an upper casing 911, a lower casing 921, an impeller 930, a motor 960 and the like. The motor 960 has a shaft 961, a rotor 963 and the like. The impeller 930 includes an upper shroud 931, a lower shroud 941 and a plurality of blades 951. A part of each blade 951 facing an inlet opening 933 has a taper shape where it becomes lower downwards as it is closer to a center part of the impeller 930.

Figure 18:
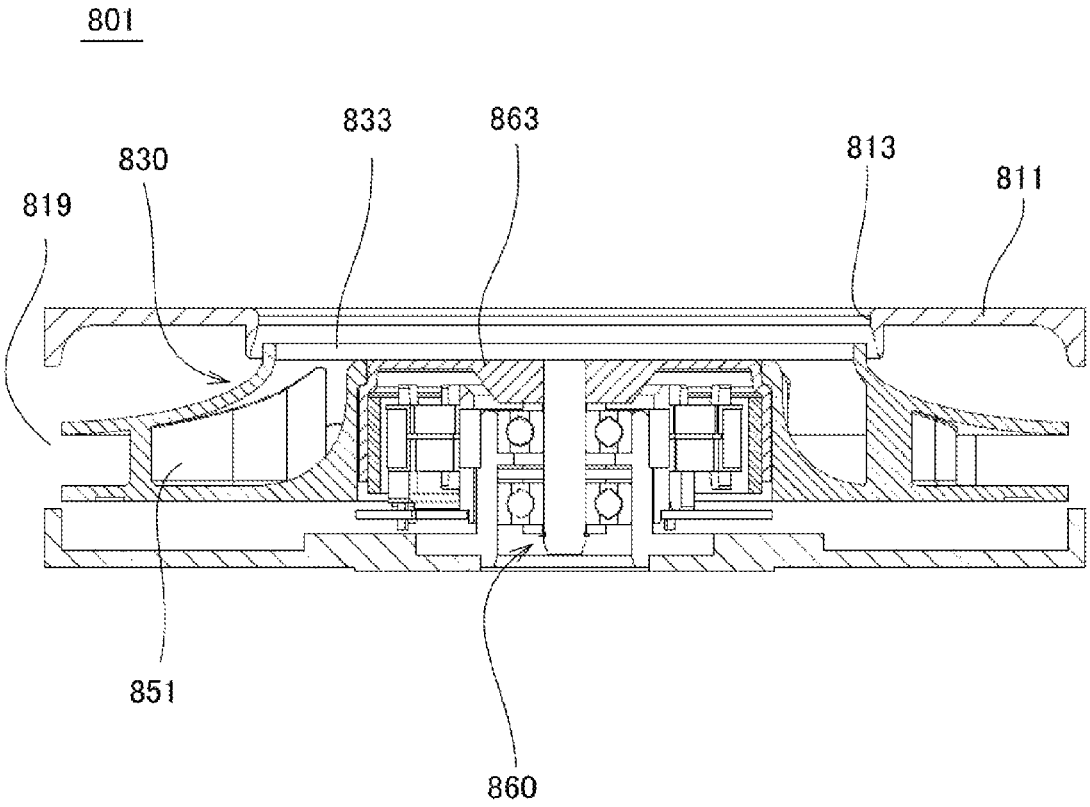
FIG. 18 is a side sectional view showing the example of the related-art centrifugal fan.

Compared to the centrifugal fan 801 shown in FIG. 18 (related-art centrifugal fan 801) or centrifugal fan 901 shown in FIG. 6 (centrifugal fan 901 of the comparative example), the centrifugal fan 1 of this illustrative embodiment can be driven with lower noise values. That is, the noise values which are generated when the centrifugal fans 1, 801, 901 are respectively driven at predetermined speed are as follows.

That is, the noise value of the related-art centrifugal fan 801 is 58 dBA, for example.

The noise value of the centrifugal fan 901 of the comparative example is 55 dBA, for example.

On the other hand, the noise value of the centrifugal fan 1 of this illustrative embodiment is 52 dBA, for example.

That is, in this illustrative embodiment, the curved surface 49 of the lower shroud 41 has the shape as described above, so that the noise value of the centrifugal fan 1 can be made smaller, compared to the related-art centrifugal fan or centrifugal fan of the comparative example.

Meanwhile, in this illustrative embodiment, the following effects can be obtained, in addition to the effects obtained by improving the air flow path, as described above.

That is, in the structure of the related-art technique shown in FIG. 18, the lower shroud of the impeller extends to the outer periphery part. Thus, when it is intended to integrally configure the impeller, a complicated mold such as slide-type is required and the productivity of the impeller is remarkably reduced. Compared to this related-art structure, in this illustrative embodiment, the impeller 30 is configured such that at least a part of the blade 51 is exposed to the partition wall part 29 and faces the partition wall part 29. Hence, a configuration of the mold for integrally forming the impeller 30 can be simplified, so that the productivity of the impeller 30 can be improved.

Also, in the structure of the related-art technique, a part of the casing positioned below the impeller is made of resin. Thus, the rigidity of the centrifugal fan is low and the vibration or noise is relatively large. Compared to this related-art structure, in this illustrative embodiment, since the lower casing 21 is configured using the metal plate, the rigidity of the centrifugal fan 1 can be increased, compared to the case where the resin is used. Thus, the vibration or noise of the centrifugal fan 1 can be reduced. Further, since the number of resin components having relatively complex shapes is reduced, the manufacturing cost of the centrifugal fan 1 can be reduced.

The casing 10 which accommodates therein the impeller 30 is not provided with a sidewall, except for the pillar parts interposed between the upper casing 11 and the lower casing 21. That is, since the side parts of the casing 10 are opened and the openings become the outlet openings 19, the air discharged in the radially outward direction of the impeller 30 is not scattered by the sidewall of the casing 10. Thus, the noise can be considerably reduced, which is caused due to the scattering of the air upon the blowing. Also, since the casing 10 does not have the sidewall and has the substantially same size as the outer diameter size of the impeller 30, the size of the centrifugal fan 1 can be reduced.

Here, the lower casing 21 of the centrifugal fan 1 has following features.

Figure 7:
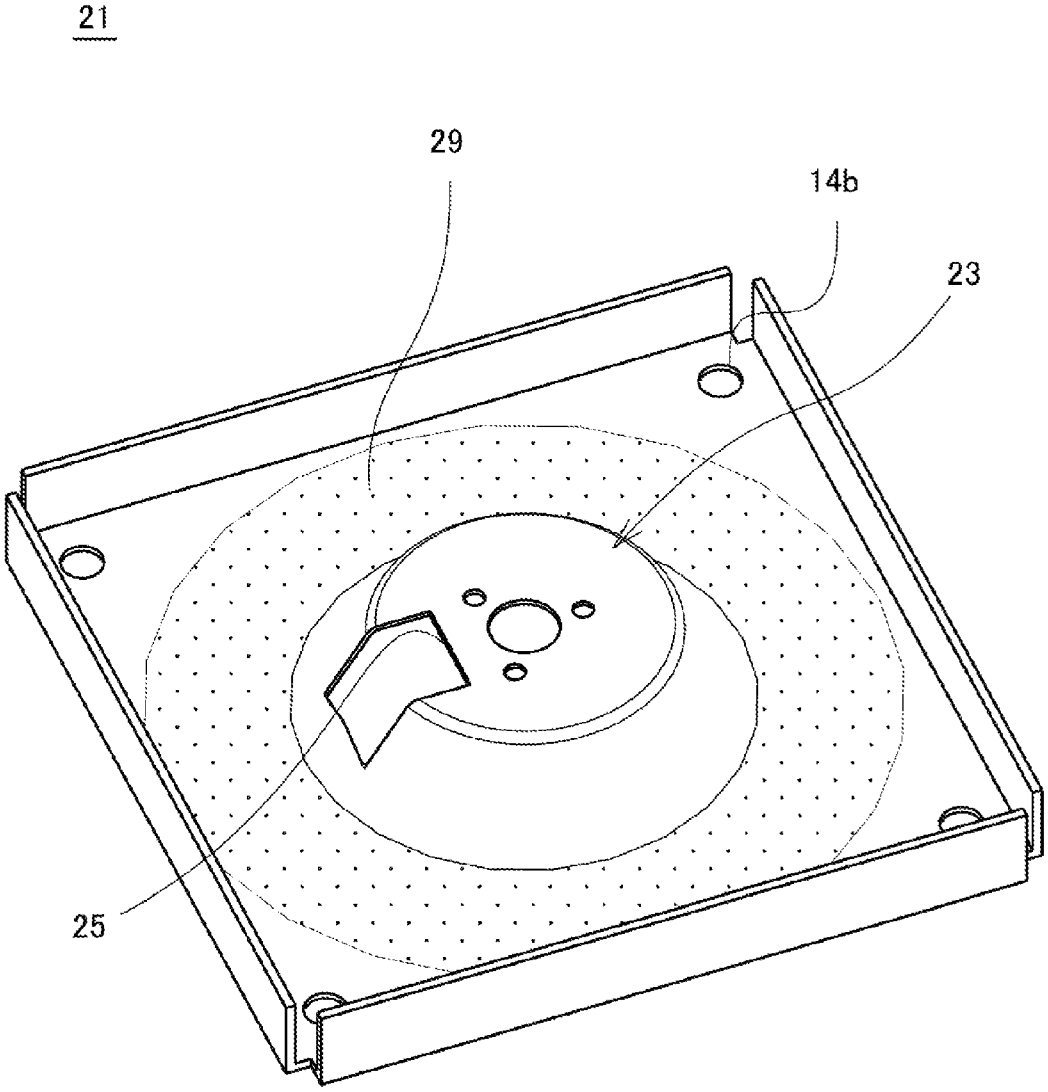
FIG. 7 is a perspective view of a lower casing, which is seen from the lower side.
Figure 8:
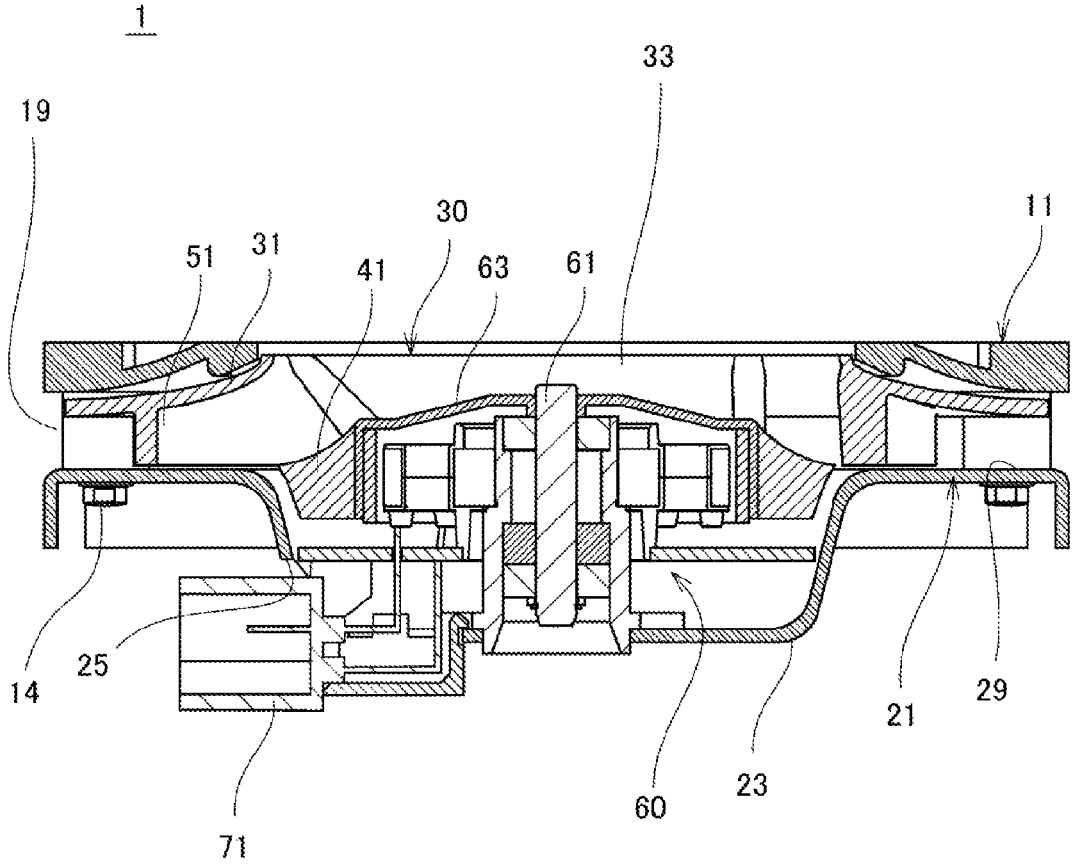
FIG. 8 is a side sectional view of the centrifugal fan along a line different from FIG. 2.

FIG. 7 is a perspective view of the lower casing 21, which is seen from the lower side. FIG. 8 is a side sectional view of the centrifugal fan 1 along a line different from FIG. 2.

As shown in FIG. 7, in this illustrative embodiment, the lower casing 21 is formed with an aperture part 25. The aperture part 25 is formed at a side of the part of the recess part 23, to which the bearing holder 66 is attached. The aperture part 25 is an aperture having a substantially rectangular shape, when seen from the plan view. The lower casing 21 is formed at four corners with screw holes 14*b* in which the screws 14 are provided.

As shown in FIG. 8, a connector 71 is attached to the aperture part 25. The connector 71 is used to feed power to the motor 60 and is connected to the motor 60 at the inner side of the recess part 23. A user can easily put the centrifugal fan 1 into a drivable state by connecting a cable for power feeding to the connector 71.

Also, a lower surface of the partition wall part 29 of the lower casing 21 is subject to waffle flattening processing, so that a plurality of small recess portions is formed. Thereby, the lower surface of the partition wall part 29 is formed with small concavity and convexity. That is, the waffle flattening processing is performed on the partition wall part 29, so that the rigidity of the partition wall part 29 is improved, the distortion is corrected and the flatness is thus increased. The waffle flattening processing may be performed on the upper and lower surfaces of the partition wall part 29 and may be performed on a part other than the partition wall part 29. The waffle flattening processing is preferably performed on at least the partition wall part 29 of the lower casing 21.

Here, the waffle flattening processing is performed on a part of the lower casing 21, so that the vibration or noise can be made relatively small, which is generated upon the driving of the centrifugal fan 1. When a thickness of the metal plate configuring the lower casing 21 is made to be thin, a degree of the generation of the vibration or noise is generally increased. However, in this illustrative embodiment, the waffle flattening processing is performed, so that the generation of the vibration or noise can be suppressed while using the thinner metal plate. Thereby, a weight of the centrifugal fan 1 can be reduced. Also, the manufacturing cost of the centrifugal fan 1 can be reduced.

Figure 9:
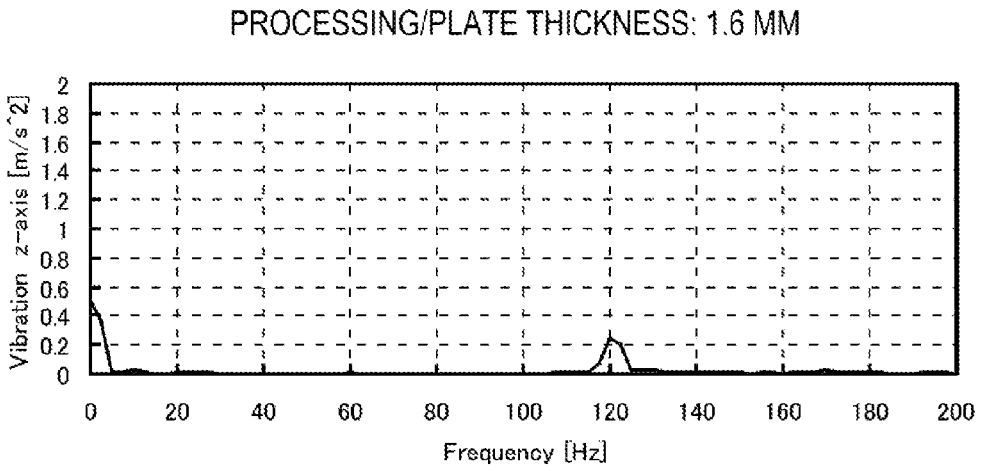
FIG. 9 is a graph showing a vibration occurrence situation when using the lower casing which is made of a metal plate having a thickness of 1.6 mm, and to which waffle flattening processing is performed.
Figure 10:
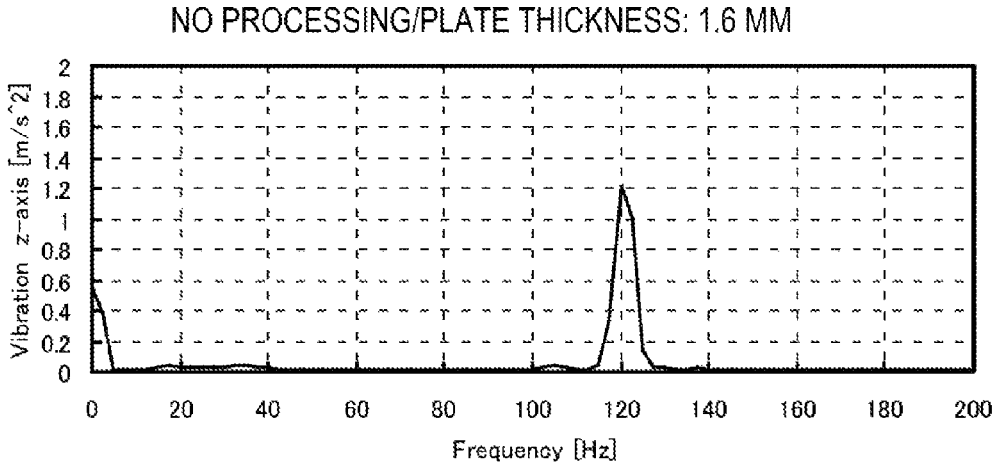
FIG. 10 is a graph showing a vibration occurrence situation when using the lower casing which is made of a metal plate having a thickness of 1.6 mm, and to which waffle flattening processing is not performed.
Figure 11:
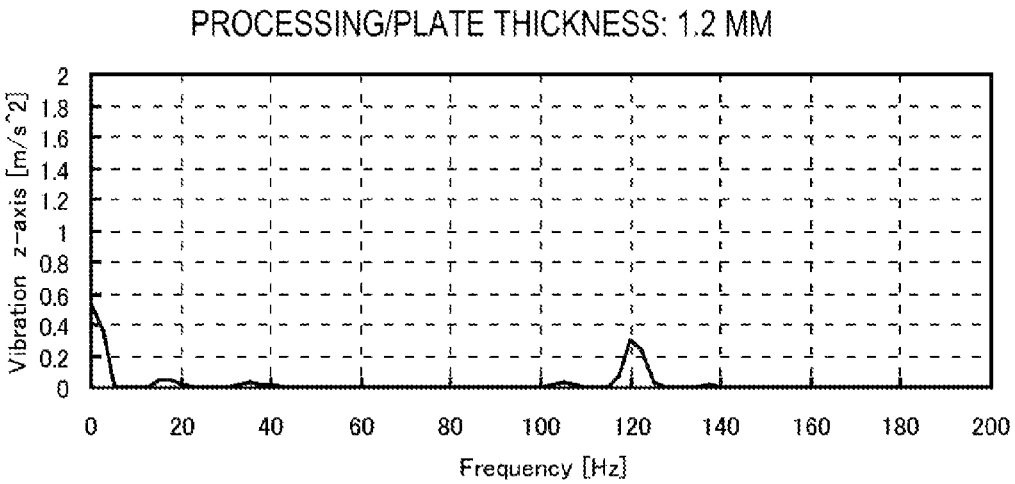
FIG. 11 is a graph showing a vibration occurrence situation when using the lower casing which is made of a metal plate having a thickness of 1.2 mm, and to which waffle flattening processing is performed.
Figure 12:
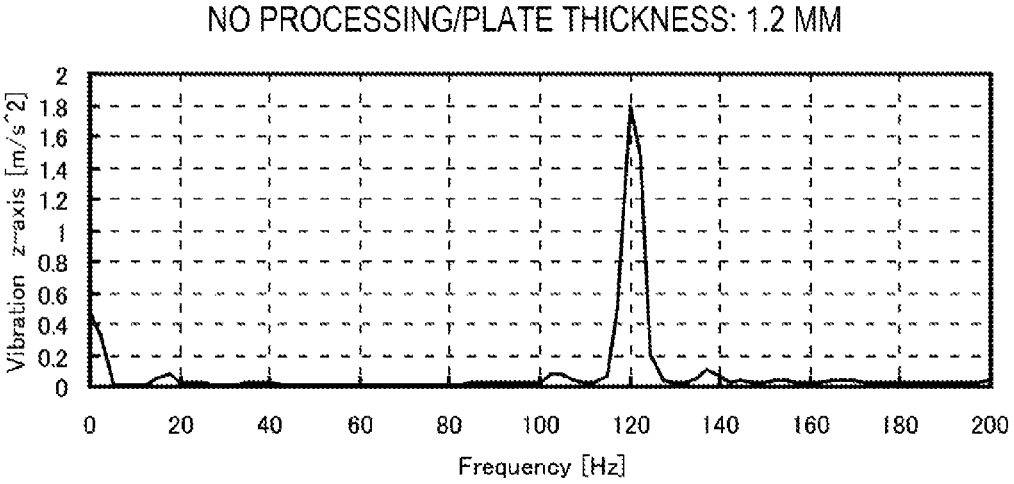
FIG. 12 is a graph showing a vibration occurrence situation when using the lower casing which is made of a metal plate having a thickness of 1.2 mm, and to which the waffle flattening processing is not performed.

FIG. 9 is a graph showing vibration occurrence situations when using the lower casing 21 which is made of a metal plate having a thickness of 1.6 mm, and to which the waffle flattening processing is performed. FIG. 10 is a graph showing vibration occurrence situations when using the lower casing 21 which is made of a metal plate having a thickness of 1.6 mm, and to which the waffle flattening processing is not performed. FIG. 11 is a graph showing vibration occurrence situations when using the lower casing 21 which is made of a metal plate having a thickness of 1.2 mm, and to which the waffle flattening processing is performed. FIG. 12 is a graph showing vibration occurrence situations when using the lower casing 21 which is made of a metal plate having a thickness of 1.2 mm, and to which the waffle flattening processing is not performed.

FIGS. 9 to 12 show measurement results which are obtained on the assumption that the centrifugal fan 1 is configured by the same members, except for the lower casing 21. The waffle flattening processing (which may be simply referred to as the processing) is performed with a pitch of 2 mm and a depth of 0.5 mm on the lower surface of the lower casing 21.

As can be seen from the comparison of FIGS. 9 and 10, when the processing is performed, a magnitude of the vibration which is generated around a frequency of 120 Hz is remarkably reduced, compared to the case where the processing is not performed. As can be seen from the comparison of FIGS. 12 and 10, when the thickness of the lower casing 21 is made to be thinner (1.2 mm), the generation of the vibration is increased if the processing is not performed. However, as can be seen from the comparison of FIGS. 10 and 11, even though the thickness of the lower casing 21 is made to be thinner, the generation of the vibration can be considerably reduced if the processing is performed, compared to the case where the lower casing is made of the thicker metal plate but the processing is not performed. When the processing is performed, the vibration is a little increased even though the lower casing 21 is made to be thinner. However, compared to the case where the processing is not performed, the vibration can be considerably reduced. Hence, the generation of the vibration of the centrifugal fan 1 can be suppressed while configuring the lower casing 21 with the relatively thin metal plate.

Modified Examples

In the meantime, the shape of the rotor is not limited to the above shape.

Figure 13:
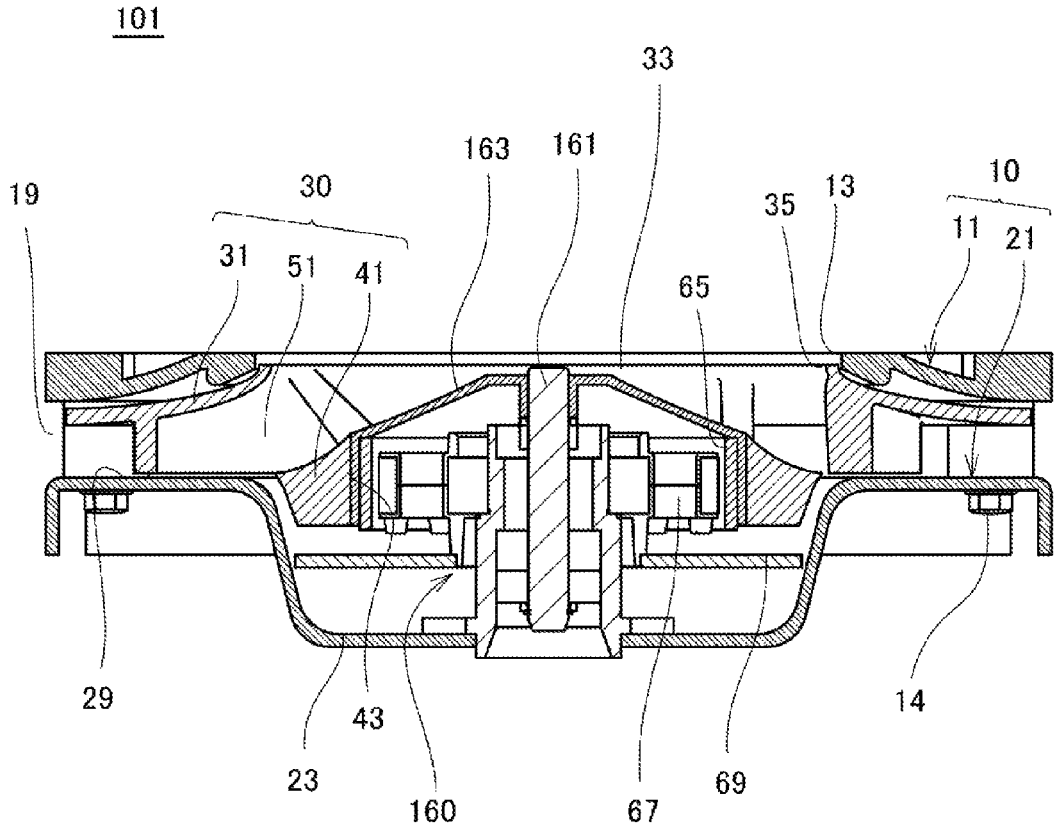
FIG. 13 is a side sectional view showing a configuration of a centrifugal fan according to a modified example of the illustrative embodiment.

FIG. 13 is a side sectional view showing a configuration of a centrifugal fan 101 according to a modified example of the above illustrative embodiment.

As shown in FIG. 13, the centrifugal fan 101 is different from the centrifugal fan 1 of the above illustrative embodiment, in that the centrifugal fan 101 has a motor 160 having a rotor 163 having a different shape. The other configurations are similar in the centrifugal fan 101 and the centrifugal fan 1.

In the rotor 163, a length of the side part in the upper-lower direction, which is attached to the lower shroud 41, is the same as that of the rotor 63. However, the rotor 163 has a cone shape on an upper surface, which is upwards higher as it is closer to the center part thereof. According to this structure, the motor 160 has a shaft 161 which is slightly longer than the shaft 61.

The upper part of the rotor 163 is formed into the cone shape, so that air guiding effect can be obtained for the air taken from the inlet opening 33. The air taken into the impeller 30 is guided to a side flow path between the upper shroud 31 and the lower shroud 41 as it is closer to the rotor 163. Therefore, the air can be caused to smoothly flow.

In the meantime, the above guiding effect may be obtained without forming the upper part of the rotor 163 into the cone shape. For example, a cone-shaped cover may be attached to the rotor 63 having a flat upper part, so that the rotor 63 and the cover form a shape, like the shape of the rotor 163 of this modified example.

Figure 14:
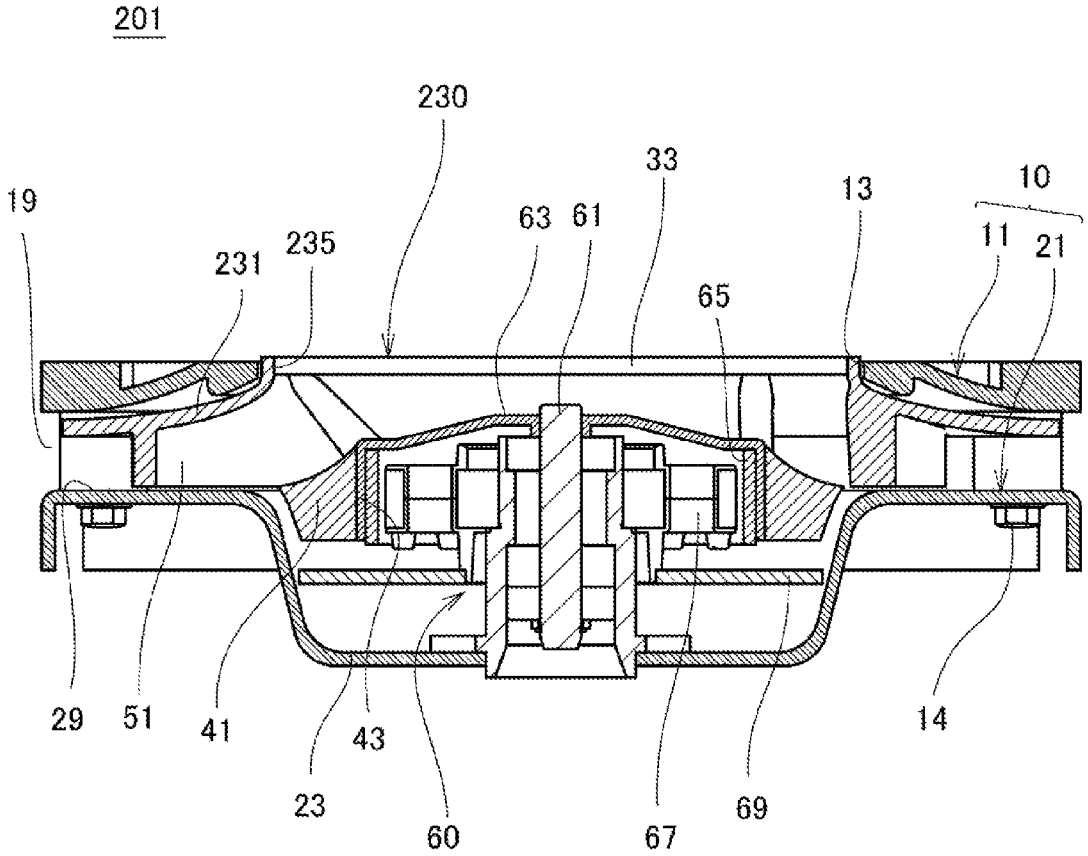
FIG. 14 is a side sectional view showing a configuration of a centrifugal fan according to another modified example of the illustrative embodiment.

FIG. 14 is a side sectional view showing a configuration of a centrifugal fan 201 according to another modified example of the above illustrative embodiment.

As shown in FIG. 14, the centrifugal fan 201 is different from the centrifugal fan 1 of the above illustrative embodiment, in that the centrifugal fan 201 has an impeller 230 having a different shape. The other configurations are similar in the centrifugal fan 201 and the centrifugal fan 1.

The impeller 230 has an upper shroud 231, a lower shroud 41 and the blades 51. A shape of an upper part of the upper shroud 231 is different from that of the upper shroud 31 of the above illustrative embodiment. In this modified example, an upper end portion of the upper shroud 231 is positioned above the upper end portion of the opening 13 of the upper casing 11. That is, in the centrifugal fan 201, the position of an upper end portion 235 of the inlet opening 33 in the upper-lower direction is higher than the opening 13.

Figure 15:
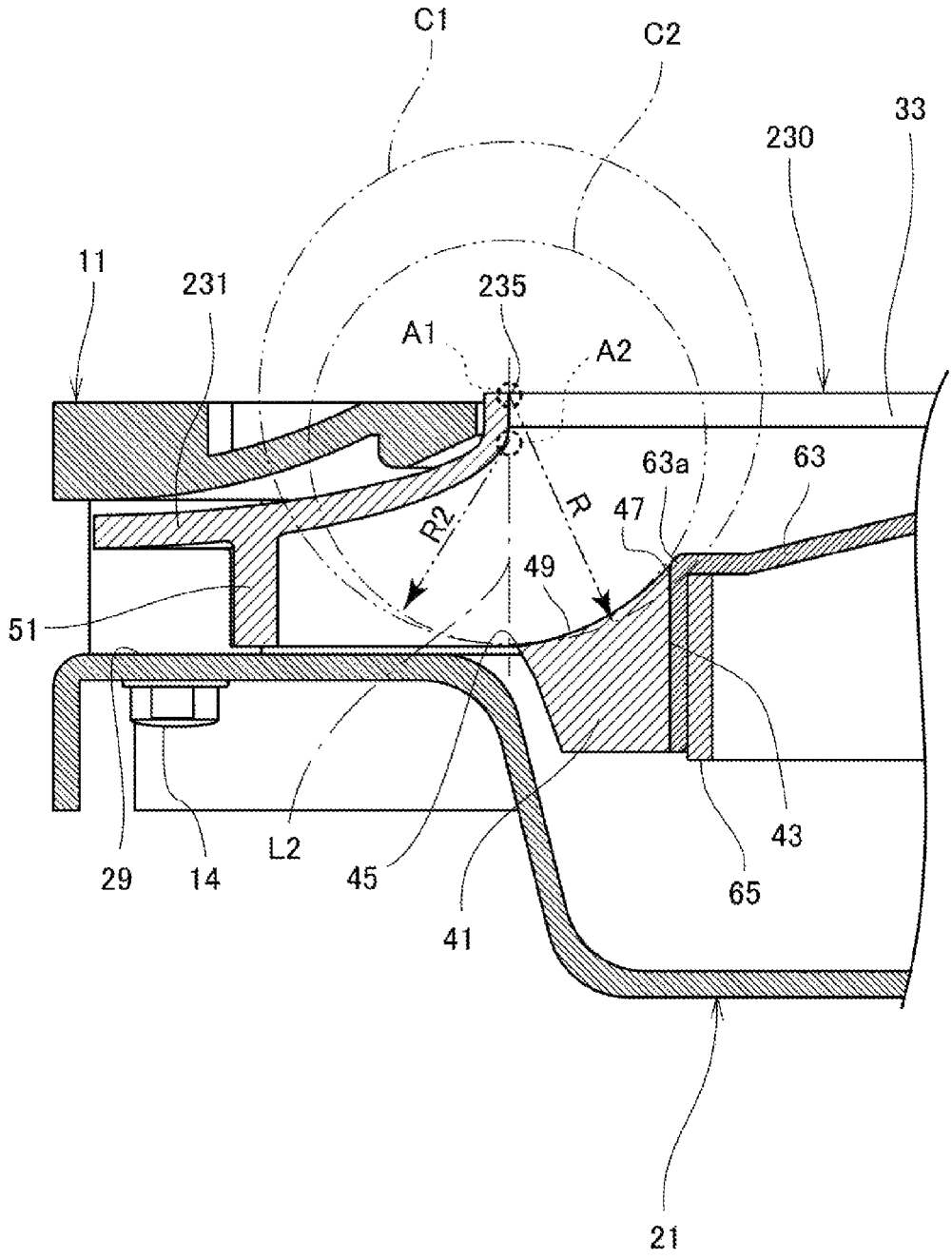
FIG. 15 is an explanatory view of a shape of an impeller of the centrifugal fan.

FIG. 15 is an explanatory view of a shape of the impeller 230 of the centrifugal fan 201.

In FIG. 15, the impeller 230 is partially enlarged, like FIG. 4. Also in this modified example, the curved surface 49 is formed into an arc shape which has a center on a line L2 passing the upper end portion 235 of the inner side of the inlet opening 33 and parallel to a rotary shaft of the impeller 230 in a section passing the rotary shaft of the impeller 230. In the section, the curved surface 49 is provided at a more outer side than the circle C2. In other words, the rotor 63 and the lower shroud 41 including the cylindrical part 43 are provided at the more outer side than the circle C2 in the section. Here, also in this modified example, the circle C2 is a circle which has a center on the line L2 and the radius R2 of 80% of the radius R of the circle C1. The circle C1 is a circle which has the upper end portion 235 as the center A1 and passes the outer periphery end portion 45 which is positioned in the vicinity of a part of the surface of the lower shroud 41 vertically below the upper end portion 235.

The impeller 230 is configured as described above, so that the air flow path from the inlet opening 33 to the outlet opening between the upper shroud 231 and the lower shroud 41 is configured to cause the air to easily flow. Thus, the generation of the noise in the centrifugal fan 201 can be suppressed.

In the meantime, the position of the upper end portion 235 of the inlet opening 33 in the upper-lower direction may be the same as the upper end portion of the opening 13.

Figure 16:
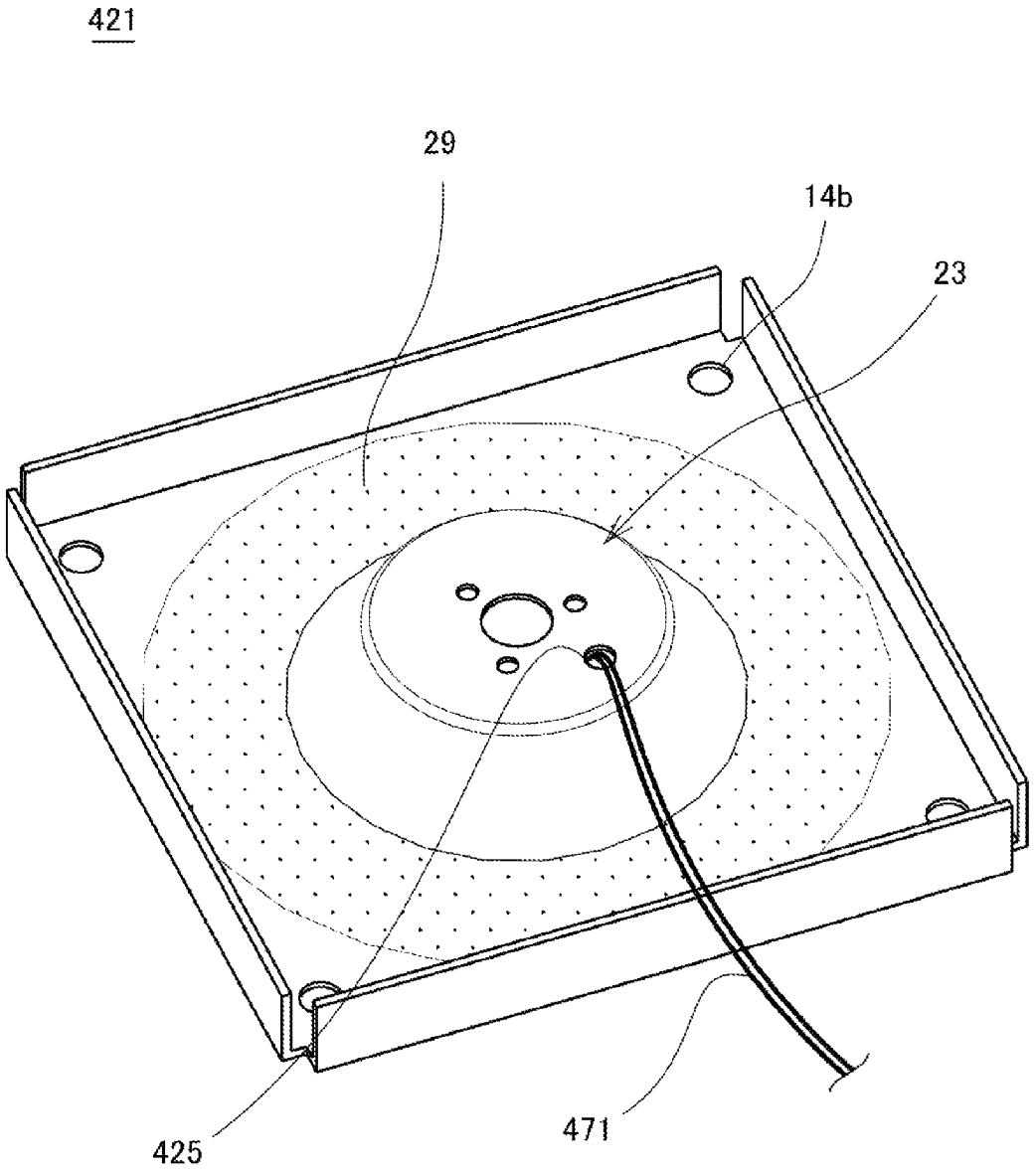
FIG. 16 is a perspective view of a lower casing of a centrifugal fan according to a further modified example of the illustrative embodiment, which is seen from the lower side.
Figure 17:
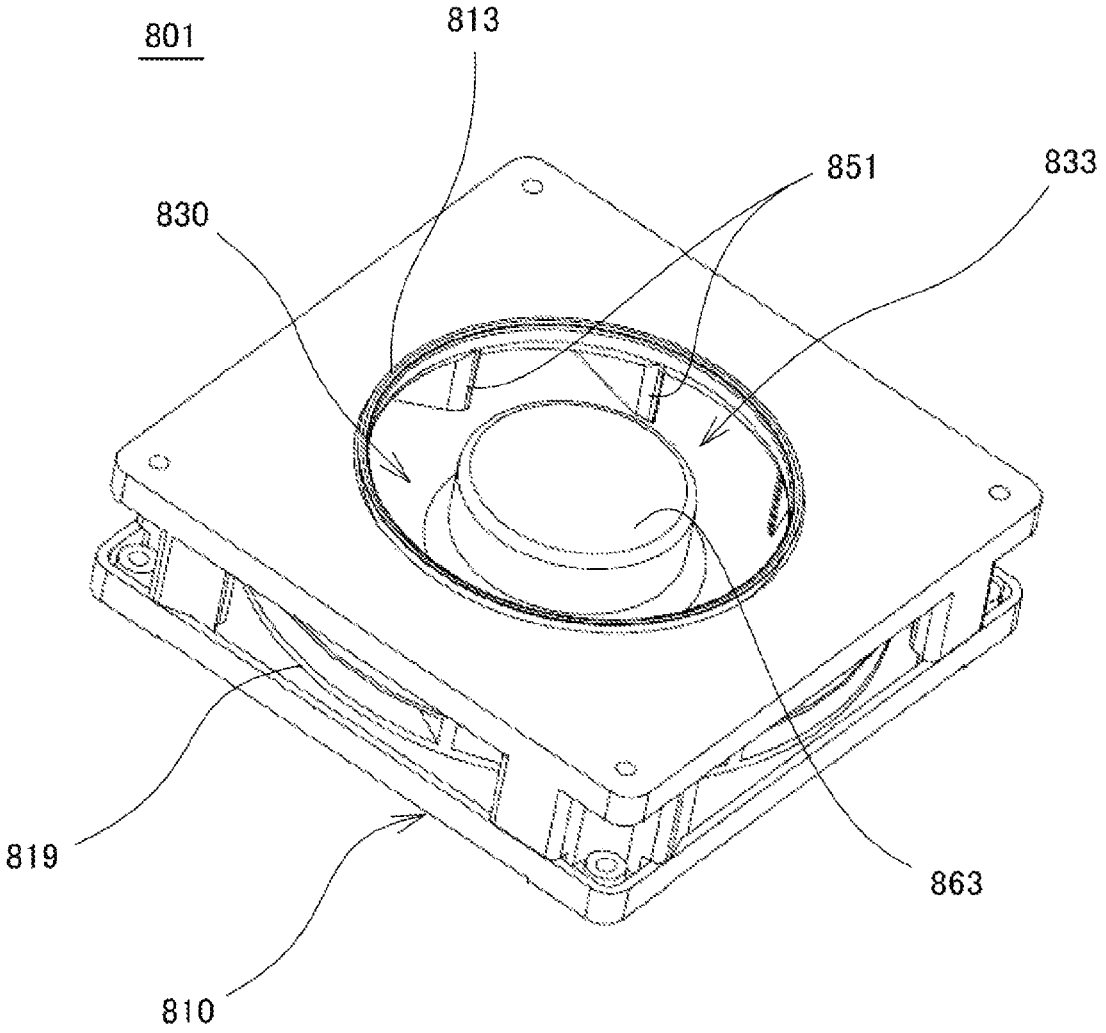
FIG. 17 is a perspective view showing an example of a related-art centrifugal fan.

FIG. 16 is a perspective view of a lower casing 421 of a centrifugal fan according to a further modified example of the above illustrative embodiment, which is seen from the lower side.

The lower casing may not be provided with an aperture part for attaching a connector. That is, as shown in FIG. 16, the lower casing 421 is not formed with the aperture part 25, unlike the lower casing 21. The lower casing 421 is formed with a wiring hole 425 at the recess part 23, for example. The wiring hole 425 is provided so as to pull out a lead wire 471, which is connected to the driving circuit of the motor 60, from the inside of the centrifugal fan to the outside. The other structures of the lower casing 421 are the same as those of the lower casing 21.

[Others]

The shape of the casing is not limited to the substantial square shape, when seen from the plan view. The casing may have an arbitrary shape including polygonal, circular and asymmetrical shapes. The fastening parts of the upper and lower casings are not limited to the inner sides of the four corners of the upper casing, when seen from the plan view. For example, screws or pillars for fastening the upper and lower casings may be provided at parts that are juncturally provided to the upper casing so that they protrude outwards from an outer peripheral edge forming a substantial square shape, when seen from the plan view of the upper casing.

In the meantime, when the pillars are provided between the upper casing and the lower casing at the fastening parts of the upper and lower casings, the pillars are preferably shaped as follows. That is, the pillar has preferably a substantially cylindrical shape having a size enabling a screw for fastening the upper and lower casings to pass therethrough. By using the pillars having the shape, the air discharged from the impeller is discharged outwards from the lateral sides of the casing while the resistance is little applied thereto. As a result, the noise of the centrifugal fan can be reduced.

The lower casing may be formed of a material other than the metal plate, such as resin material. The upper and lower casings may be integrally formed.

It should be considered that the above illustrative embodiments are just exemplary and are not limitative. The scope of the present invention is defined by the claims, not by the above descriptions, and includes all changes in the meaning and scope equivalent to the claims.

What is claimed is:

1. A centrifugal fan comprising:

a casing having an upper casing and a lower casing, wherein the casing has four lateral side, the lower casing being made of metal, wherein the lower casing has a recessed portion which projects downward at a center part of the lower casing so that a projected part is formed on a back surface of the lower casing;

an impeller disposed within the casing, wherein the impeller includes an upper shroud, a lower shroud, and a plurality of blades arranged in a circumference direction between the upper shroud and the lower shroud;

a motor installed in the recessed portion of the lower casing, the motor having a rotor to rotate the impeller;

an outlet opening is provided on each of the four lateral sides to discharge a fluid from the impeller; and an aperture part for guiding a member for feeding power to the motor is provided with the projected part formed on the back surface of the lower casing, wherein the aperture part is arranged below the outlet opening in an axial direction of a rotation axis of the motor, wherein the projected part has a horizontal surface substantially perpendicular to the axial direction and an inclined surface surrounding outside of the horizontal surface as seen from the axial direction, and wherein the aperture part is formed to cross a boundary between the horizontal surface and the inclined surface.

2. The centrifugal fan according to claim 1, wherein the lower casing has a side plate which is bent in a direction opposite to the upper casing from an outer periphery portion of the lower casing.

3. The centrifugal fan according to claim 1, wherein each of the blades has an inclined inner circumference edge that is provided between the upper shroud and the lower shroud.

4. The centrifugal fan according to claim 1, wherein the member is a connector which is attached with the aperture part.

5. The centrifugal fan according to claim 1, wherein the upper casing has a circular opening through which the fluid is suctioned into the casing, and wherein a ratio of a height from a lower end of each blade to an inlet opening formed at an upper part of the upper shroud in the axial direction with respect to an inner diameter of the circular opening is within a range of 15% or large and 25% or smaller.

6. The centrifugal fan according to claim 5, wherein a position of the upper end portion of the inlet opening in the axial direction is same as or higher than an upper end portion of the circular opening.

* * * * *